United States Patent [19]

Drysh

[11] 4,258,868

[45] Mar. 31, 1981

[54] LIMIT STOP FOR CONTROLLING STOPPER ROD TRAVEL IN A BOTTOM POUR LADLE

[75] Inventor: Leo I. Drysh, St. Charles, Ill.

[73] Assignee: Moline Corporation, St. Charles, Ill.

[21] Appl. No.: 63,371

[22] Filed: Aug. 3, 1979

[51] Int. Cl.[3] ..... B22D 41/10

[52] U.S. Cl. ..... 222/602; 222/504; 251/234; 251/285

[58] Field of Search ..... 222/504, 559, 602; 251/144, 232, 234, 285

[56] References Cited

U.S. PATENT DOCUMENTS

| | | | |
|---|---|---|---|
| 3,012,373 | 12/1961 | Willis | 73/304 R |
| 3,299,706 | 1/1967 | Bailey et al. | 73/304 R |
| 3,370,466 | 2/1968 | Chang | 73/304 R |
| 3,395,908 | 8/1968 | Woodcock | 266/99 |
| 3,486,660 | 12/1969 | Heintz | 222/590 |
| 3,667,296 | 6/1972 | Schiefer et al. | 73/304 R |
| 3,703,248 | 11/1972 | Seaton | 222/602 |
| 3,733,014 | 5/1973 | Pflaum | 222/602 |
| 3,762,605 | 10/1973 | Seaton | 222/559 X |
| 3,896,671 | 7/1975 | Marinaccio | 73/304 R |
| 3,944,845 | 3/1976 | Luteran | 307/118 |
| 4,037,761 | 7/1977 | Kemlo et al. | 222/590 |

*Primary Examiner*—David A. Scherbel

*Attorney, Agent, or Firm*—Kinzer, Plyer, Dorn & McEachran

[57] ABSTRACT

A ladle for the pouring of a heated molten material such as iron or the like includes a ladle body defining a chamber for holding a heated molten material. There is a bottom pour opening in the chamber and a stopper rod is movable between open and closed positions relative to the pour opening to control the flow of molten material therethrough. An arm is pivotally supported on the side of the ladle and in turn is pivotally connected to the stopper rod. An air cylinder is attached to the arm for causing movement thereof to thereby effect movement of the stopper rod between the described open and closed positions. There is an adjustable rod positioned between the air cylinder causing movement of the pivotal arm and the point of pivotal attachment of the arm to the ladle to thereby control the length of travel of the stopper rod and thus the degree to which the pour opening is exposed by the stopper rod.

1 Claim, 3 Drawing Figures

LIMIT STOP FOR CONTROLLING STOPPER ROD TRAVEL IN A BOTTOM POUR LADLE

SUMMARY OF THE INVENTION

The present invention relates to apparatus for controlling movement of a stopper rod used in a bottom pour ladle and has particular application to the pouring of molten material such as iron or steel.

One purpose of the present invention is a means for controlling the travel of a stopper rod to thereby regulate flow of material through a bottom pour opening as the amount of material within the ladle decreases so as to provide a constant amount of molten metal in the individual molds which are passing beneath the ladle.

Another purpose is a simply constructed reliably operable means for controlling movement of a stopper rod in the described environment so as to provide controlled amounts of metal in a series of molds passing beneath the ladle.

Another purpose is an apparatus of the type described which may be controlled by a nearby operator during the pouring process.

Another purpose is a mechanical structure for controlling the length of travel of a stopper rod used with a bottom pour ladle.

Other purposes will appear in the ensuing specification, drawings and claims.

BRIEF DESCRIPTION OF THE DRAWINGS

The invention is illustrated diagrammatically in the following drawings wherein.

DESCRIPTION OF THE PREFERRED EMBODIMENT

It is the practice in iron foundries which use bottom pour ladles and in which a series of sand molds are being indexed under the ladle for the operator to change the length of travel of the ladle stopper rod as the volume of metal within the ladle is decreased. It is well understood that as the volume of metal in the ladle decreases, the rate of flow through the bottom pour opening will also decrease. Hence, the operator must make adjustments to movement of the stopper rod in order to provide the correct amount of metal in each mold. In the past, this required a shutdown of the entire apparatus, as there was no way to regulate the length of travel of the stopper rod without stopping the moving sand molds and then manually adjusting stopper rod travel. The present invention provides a means for changing the length of travel of the stopper rod during operation. The operator can control length of travel of the stopper rod and hence the amount of metal being poured into the molds without in any way delaying production. The operator watches the metal flowing into the mold and controls the length of travel of the stopper rod by the mechanical apparatus disclosed herein.

Figure 1:
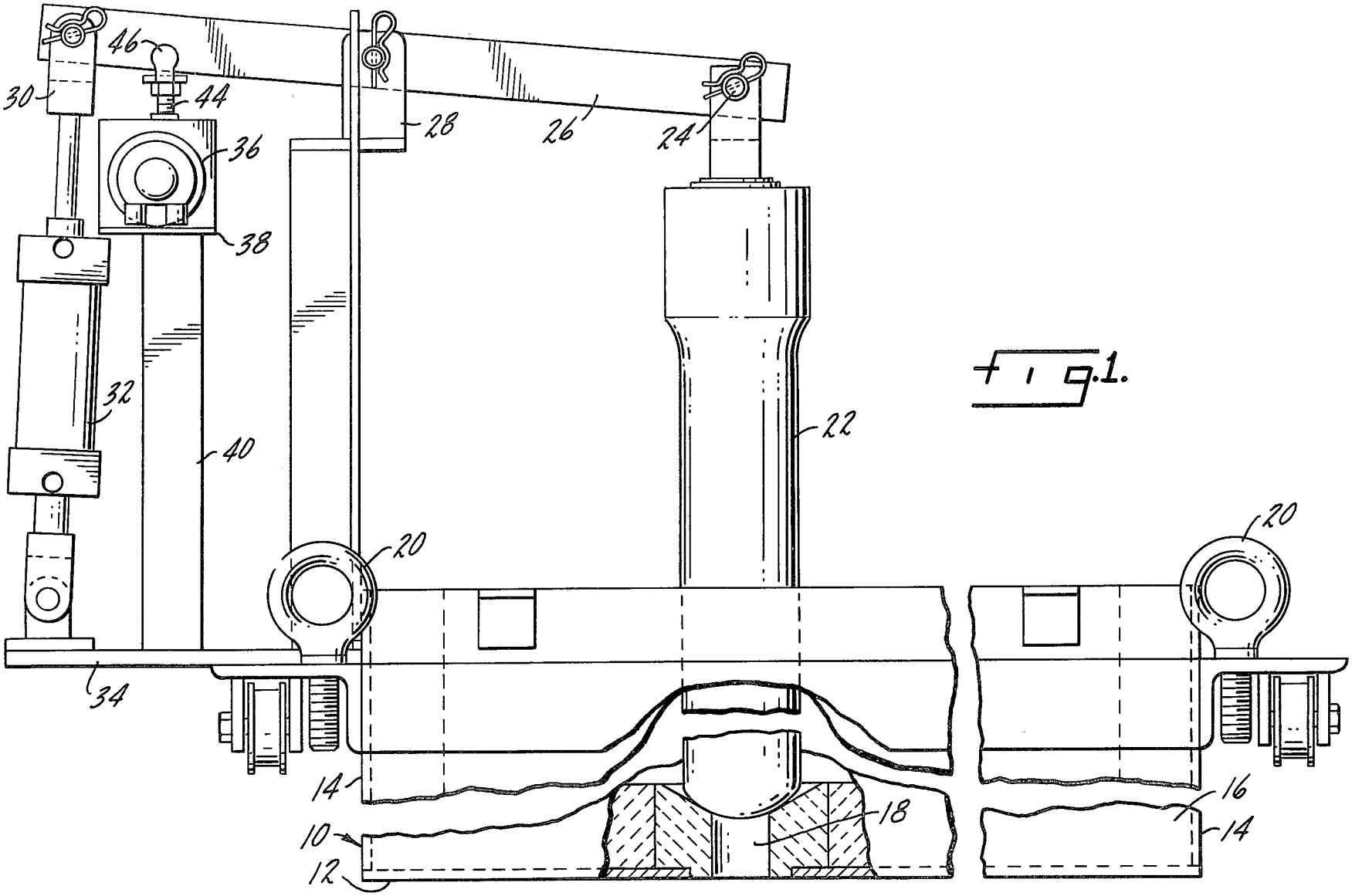
FIG. 1 is a side view of the control apparatus disclosed herein, as mounted on a ladle, with portions of the ladle removed.
Figure 2:
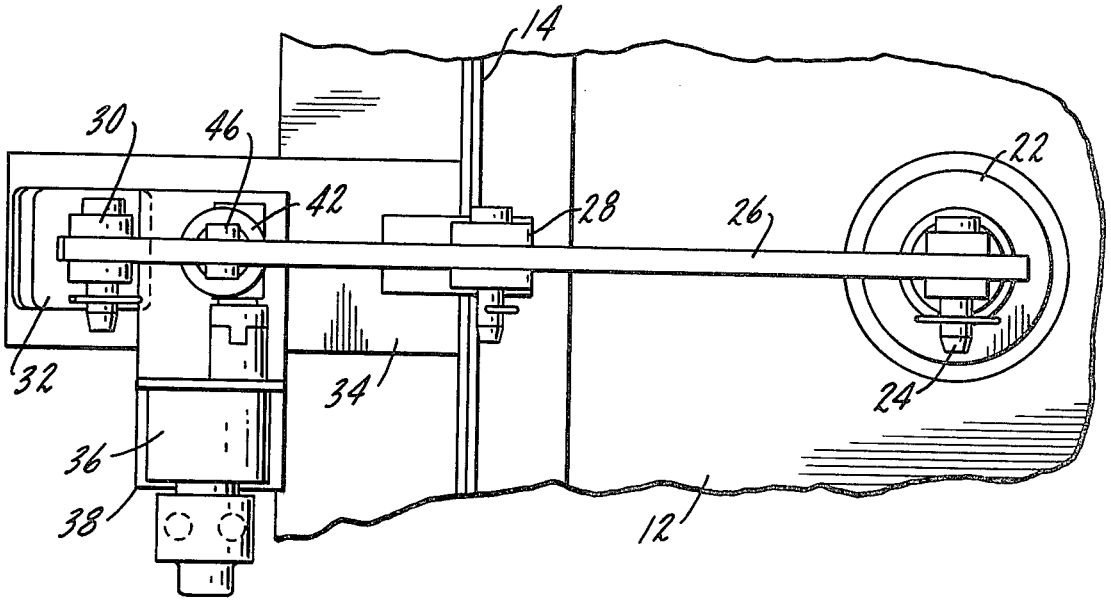
FIG. 2 is a partial top view of the apparatus of FIG. 1.

Referring specifically to FIG. 1, a ladle body is indicated generally at 10 and may have a bottom 12, ends 14 and sides, one of which is indicated at 16. The ladle will define an interior chamber or zone which customarily will hold molten material, whether it be iron, steel or some other material such as glass or the like which is to be poured into a series of molds.

The bottom 12 has an opening 18 through which the metal is poured into the molds passing beneath the ladle. There are hooks 20 on the sides 14 of the ladle body and the hooks will customarily be used in removing the ladle for repairs.

A stopper rod is indicated at 22 and will be reciprocally moved toward and away from opening 18 to control the flow of metal therethrough. The degree to which the stopper rod is moved relative to opening 18 determines the amount of metal which will flow through it. As indicated above, as the volume of metal within the ladle decreases, the pressure causing flow through the opening will decrease and hence the stopper rod must, accordingly, have a greater length of travel or must move further away from the opening to provide a constant flow of metal to each mold.

Stopper rod 22 is pivotally attached, as at 24, to one end of an arm 26 which is in turn pivotally attached to a support 28 positioned upon one side 14 of the ladle body. The opposite end of arm 26 is pivotally attached to a piston rod 30, movement of which is controlled by an air cylinder 32. The other end of cylinder 32 is pivotally attached to a bracket 34 extending outwardly from side 14. Without the structure hereinafter described, the air cylinder would effect a pivotal movement of arm 26 about support 28 which in turn would cause stopper rod 22 to move a constant distance away from and toward pour opening 18.

An air motor 36 is positioned upon a plate 38 which in turn is supported on a beam 40 extending upwardly from bracket 34. Air motor 36 has a worm drive output, which worm drive output is in mesh with a gear within jack screw housing 42. The gear within jack screw housing 42 is attached to a jack screw 44 extending upwardly from the housing. Hence, rotation of the air motor will effect up and down movement of jack screw 42. The upper end of jack screw 42 supports a yoke 46 which in turn is positioned for contact with arm 26. The position of jack screw 44 and its supported yoke 46 will limit the travel of arm 26 and hence limit movement of stopper rod 22. For example, as the jack screw is raised, it will decrease upward travel of the stopper rod. As the jack screw is lowered it will permit greater upward movement of the stopper rod. Hence, the position of the jack screw as controlled by air motor 36 will control travel of the stopper rod.

Figure 3:
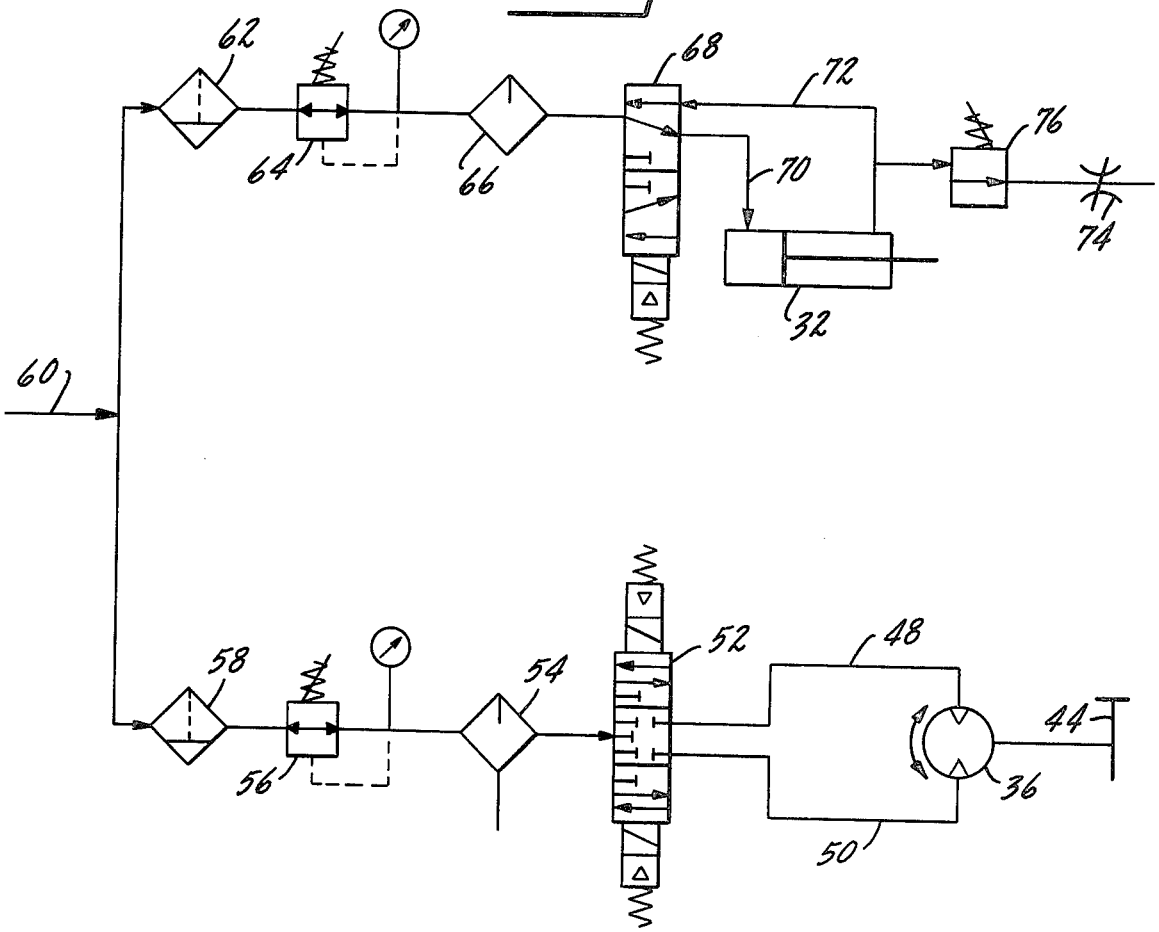
FIG. 3 is a schematic illustration of the air control circuit used to control movement of the stopper rod herein.

Looking at FIG. 3, air motor 36 and its connection to jack screw 44 are diagrammatically illustrated. Two input lines for air motor 36 are indicated at 48 and 50 and these lines are connected to a four-way three-position double solenoid valve 52 which is in turn connected through an air line lubricator 54, an air pressure regulator 56 and an air filter 58 to a source of pneumatic pressure indicated by arrow 60. Thus, pressure from source 60 can be used to drive air motor 36 in either of two directions, indicated by the arrows adjacent the air motor in FIG. 3, as determined by the position of four-way solenoid valve 52. This portion of the pneumatic circuit is used when it is necessary to change the position of the jack screw to change the length of travel of the stopper rod.

Also connected to pneumatic source 60 is a second air filter 62 and pressure regulator 64, as well as an air line lubricator 66, the output of which is connected to a four-way two-position solenoid valve 68. Valve 68 provides inputs along lines 70 and 72 to air cylinder 32 which are used to effect actual movement of the stopper rod. A flow control valve 74 is connected to a two-way solenoid valve 76 which in turn is connected to air line 72. Thus, if it is necessary to move the jack screw against the pressure within cylinder 32, solenoid valve 76 is operated to bleed off air within the cylinder so that there is less resistance to movement of the jack screw. This normally would take place when the jack screw was being raised and cylinder 32 had already moved or was holding the stopper rod away from pour opening 18.

Of particular advantage is the simple and reliable means for controlling pivotal movement of arm 26 and thus movement of the stopper rod. The air motor and jack screw operated thereby are known mechanical elements which are relatively fail safe in day-to-day operation. Although I have described a manual system to the extent that the operator watches the metal pouring into the indexed sand molds and regulates the jack screw accordingly, it may be possible to use the mechanical arrangement shown in coordination with one or more automatic means for sensing the level of metal within the mold or some other factor which may directly relate to the flow of metal through the bottom pour opening.

Whereas the preferred form of the invention has been shown and described herein, it should be realized that there may be many modifications, substitutions and alterations thereto.

The embodiments of the invention in which an exclusive property or privilege is claimed are defined as follows:

1. A ladle for the pouring of a heated molten material such as iron including a ladle body defining a chamber for holding a heated molten material, a bottom pour opening in said chamber, a stopper rod movable between open and closed positions relative to said pour opening to control the flow of molten material therethrough, an arm pivotally supporting said stopper rod, operating means attached to said arm for causing movement thereof to thereby move said stopper rod between open and closed positions relative to said pour opening, the improvement comprising means for adjustably controlling movement of said arm to thereby vary travel of said stopper rod relative to said pour opening, including a stop arranged for contact with said arm for limiting movement thereof, means for adjustably moving said stop including an air motor connected thereto, an air cylinder forming a part of said operating means for said stopper rod and being in pneumatic circuit with said air motor, and a flow control valve connected to said air cylinder for reducing the pressure therein to reduce resistance by said air cylinder to movement of said stop by said air motor thereby permitting movement of said stop during operation of said stopper rod.

* * * * *